US010789890B2

(12) United States Patent
Kang et al.

(10) Patent No.: US 10,789,890 B2
(45) Date of Patent: Sep. 29, 2020

(54) PIXEL AND DISPLAY DEVICE HAVING THE SAME

(71) Applicant: Samsung Display Co., Ltd., Yongin-si, Gyeonggi-do (KR)

(72) Inventors: Chul Kyu Kang, Suwon-si (KR); Sangmoo Choi, Yongin-si (KR); Dae Hyun Kim, Seoul (KR); Dongsun Lee, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 16/503,106

(22) Filed: Jul. 3, 2019

(65) Prior Publication Data

US 2020/0013338 A1 Jan. 9, 2020

(30) Foreign Application Priority Data

Jul. 6, 2018 (KR) ..... 10-2018-0078508

(51) Int. Cl.

| | |
|---|---|
| ***G09G 3/32*** | (2016.01) |
| ***G09G 3/3258*** | (2016.01) |
| ***G09G 3/3275*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3275* (2013.01)

(58) Field of Classification Search

CPC ..... G09G 3/32

See application file for complete search history.

(56) References Cited

U.S. PATENT DOCUMENTS

2016/0064700 A1* 3/2016 Pyon ..... H01L 27/3248 257/40
2017/0301289 A1* 10/2017 Jeong ..... G09G 3/3233
2018/0190185 A1* 7/2018 Ko ..... G09G 3/3233

FOREIGN PATENT DOCUMENTS

KR 10-0604059 B1 7/2006
KR 10-0673759 B1 1/2007
KR 10-2015-0144893 A 12/2015
KR 10-1760090 B1 7/2017

* cited by examiner

*Primary Examiner* — Chanh D Nguyen
*Assistant Examiner* — Nguyen H Truong
(74) *Attorney, Agent, or Firm* — Innovation Counsel LLP

(57) ABSTRACT

A display device includes a display panel including a plurality of pixels and a panel driver that drives the display panel. Each of the pixels includes a first transistor, a second transistor, a third transistor, a fourth transistor, a fifth transistor, a sixth transistor, a seventh transistor, an eighth transistor, a first capacitor, and an emission element.

20 Claims, 12 Drawing Sheets

PIXEL AND DISPLAY DEVICE HAVING THE SAME

CROSS-REFERENCE TO RELATED APPLICATION(S)

This application claims priority under 35 USC § 119 to Korean Patent Application No. 10-2018-0078508, filed on Jul. 6, 2018 in the Korean Intellectual Property Office (KIPO), the contents of which are incorporated herein in its entirety by reference.

BACKGROUND

1. Technical Field

Example embodiments relate generally to a pixel and a display device having the same.

2. Description of the Related Art

Flat panel display (FPD) devices are widely used as a display device of electronic devices because FPD devices are relatively lightweight and thin compared to cathode-ray tube (CRT) display device. Examples of FPD devices are liquid crystal display (LCD) devices, field emission display (FED) devices, plasma display panel (PDP) devices, and organic light emitting display (OLED) devices. The OLED devices have been spotlighted as next-generation display devices because the OLED devices have various advantages such as a wide viewing angle, a rapid response speed, a thin thickness, low power consumption, etc.

A pixel of the organic light emitting display device may include a storage capacitor in which a data voltage is stored and a driving transistor that generates a driving current based on the data voltage. The pixel of the organic light emitting display device may further include elements for compensating a threshold voltage of the driving transistor and initializing an anode electrode of an organic light emitting diode to improve display defects such as deviation of luminance. Leakage current may occur through leakage paths by transistors coupled to the driving transistor after a writing period in which the data voltage is written. The display defects such as light spot defect may occur because the luminance of the pixel is changed by the leakage current.

SUMMARY

Some example embodiments provide a pixel of a display device capable of improving display quality.

Some example embodiments provide a display device capable of improving display quality.

According to an aspect of example embodiments, a pixel of a display device may include first through eighth transistors, a first capacitor, and an emission element. The first transistor includes a gate electrode coupled to a first node, a first electrode coupled to a second node, and a second electrode coupled to a third node. The second transistor includes a gate electrode that is configured to receive a first gate signal, a first electrode that is configured to receive a data voltage, and a second electrode coupled to the third node. The third transistor includes a gate electrode that is configured to receive the first gate signal, a first electrode coupled to a fourth node, and a second electrode coupled to the second node. The fourth transistor includes a gate electrode that is configured to receive a second gate signal, a first electrode coupled to the fourth node, and a second electrode that is configured to receive an initialization voltage. The fifth transistor includes a gate electrode that is configured to receive a first emission control signal, a first electrode that is configured to receive a first power voltage, and a second electrode coupled to the second node. The sixth transistor includes a gate electrode that is configured to receive the first emission control signal, a first electrode coupled to the third node, and a second electrode coupled to a fifth node. The seventh transistor includes a gate electrode that is configured to receive a third gate signal, a first electrode that is configured to receive the initialization voltage, and a second electrode coupled to the fifth node. The eighth transistor includes a gate electrode that is configured to receive a second emission control signal, a first electrode coupled to the first node, and a second electrode coupled to the fourth node. The first capacitor includes a first electrode that is configured to receive the first power voltage and a second electrode coupled to the first node. The emission element includes a first electrode coupled to the fifth node and a second electrode that is configured to receive a second power voltage.

In example embodiments, the second emission control signal may be an inversion signal of the first emission control signal.

In example embodiments, the pixel of display device may further include a second capacitor coupled between the second electrode of the eighth transistor and the fourth node.

In example embodiments, the first gate signal, the second gate signal, and the third gate signal may be activated more than one time in a frame, and the second emission control signal may be activated once in a frame.

In example embodiments, the gate electrode of the first transistor may be initialized with the initialization voltage while the second gate signal and the second emission control signal are activated and the first gate signal, the third gate signal, and the first emission control signal are inactivated.

In example embodiments, the first electrode of the emission element may be initialized with the initialization voltage and the data voltage that compensates a threshold voltage of the first transistor is written while the first gate signal, the third gate signal, and the second emission control signal are activated and the second gate signal and the first emission control signal are inactivated.

In example embodiments, the emission element may emit light while the first emission control signal is activated and the first gate signal, the second gate signal, and the third gate signal are inactivated.

In example embodiments, the fourth node may be initialized with the initialization voltage while the second gate signal is activated and the first gate signal, the third gate signal, the first emission control signal, and the second emission control signal are inactivated.

In example embodiments, the first electrode of the emission element may be initialized with the initialization voltage and the fourth node may be initialized with the data voltage while the first gate signal and the third gate signal are activated and the second gate signal, the first emission control signal and the second emission control signal are inactivated.

According to an aspect of example embodiments, a display device may include a display panel including a plurality of pixels and a panel driver that is configured to drive the display panel. Each of the pixels may include first through eighth transistors, a first capacitor, and an emission element. The first transistor includes a gate electrode coupled to a first node, a first electrode coupled to a second node, and a second electrode coupled to a third node. The second transistor includes a gate electrode that is configured to receive a first gate signal, a first electrode that is configured to receive a data voltage, and a second electrode coupled to the third electrode. The third transistor includes a gate electrode that is configured to receive the first gate signal, a first electrode coupled to a fourth node, and a second electrode coupled to the second node. The fourth transistor includes a gate electrode that is configured to receive a second gate signal, a first electrode coupled to the fourth node, and a second electrode that is configured to receive an initialization voltage. The fifth transistor includes a gate electrode that is configured to receive a first emission control signal, a first electrode that is configured to receive a first power voltage, and a second electrode coupled to the second node. The sixth transistor includes a gate electrode that is configured to receive the first emission control signal, a first electrode coupled to the third node, and a second electrode coupled to a fifth node. The seventh transistor includes a gate electrode that is configured to receive a third gate signal, a first electrode that is configured to receive the initialization voltage, and a second electrode coupled to the fifth node. The eighth transistor includes a gate electrode that is configured to receive a second emission control signal, a first electrode coupled to the first node, and a second electrode coupled to the fourth node. The first capacitor includes a first electrode that is configured to receive the first power voltage and a second electrode coupled to the first node. The emission element includes a first electrode coupled to the fifth node and a second electrode that is configured to receive a second power voltage.

In example embodiments, the second emission control signal may be an inversion signal of the first emission control signal.

In example embodiments, the display device further includes a second capacitor coupled between the second electrode of the eighth transistor and the fourth node.

In example embodiments, the panel driver may be configured to drive the pixels in a driving method that includes a first period during which the gate electrode of the first transistor is initialized, a second period during which the first electrode of the emission element is initialized and the data voltage that compensates a threshold voltage of the first transistor is written, and a third period during which the emission element emits light.

In example embodiments, the second gate signal and the second emission control signal may be activated and the first gate signal, the third gate signal, and the first emission control signal may be inactivated in the first period.

In example embodiments, the first gate signal, the third gate signal, and the second emission control signal may be activated and the second gate signal, and the first emission control signal may be inactivated in the second period.

In example embodiments, the first emission control signal may be activated, and the first gate signal, the second gate signal, the third gate signal, and the second emission control signal may be inactivated during the third period.

In example embodiments, the driving method may further include a fourth period and a fifth period during which the fourth node is refreshed.

In example embodiments, the second gate signal may be activated and the first gate signal, the third gate signal, the first emission control signal, and the second emission control signal may be inactivated during the fourth period.

In example embodiments, the first gate signal and the third gate signal may be activated, and the second gate signal, the first emission control signal, and the second emission control signal may be inactivated during the fifth period.

In example embodiments, the driving method may include the third period, the fourth period, and the fifth period more than one time in a frame Therefore, the pixel of the display device may stabilize a voltage of the fourth node during an emission period by coupling the eighth transistor between the first node corresponding to the gate electrode of the first transistor (i.e., the driving transistor) and the fourth node and coupling the third transistor between the fourth node and the second node corresponding to the first electrode of the first transistor. A driving current generated in the first transistor may be constantly maintained by maintaining the gate voltage applied to the gate electrode of the first transistor during the emission control signal because the voltage of the fourth node is stabilized. Thus, the defect occurring by the change of luminance of the pixel (such as spot defect) may be improved.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, the present inventive concept will be explained in detail with reference to the accompanying drawings.

Figure 1:
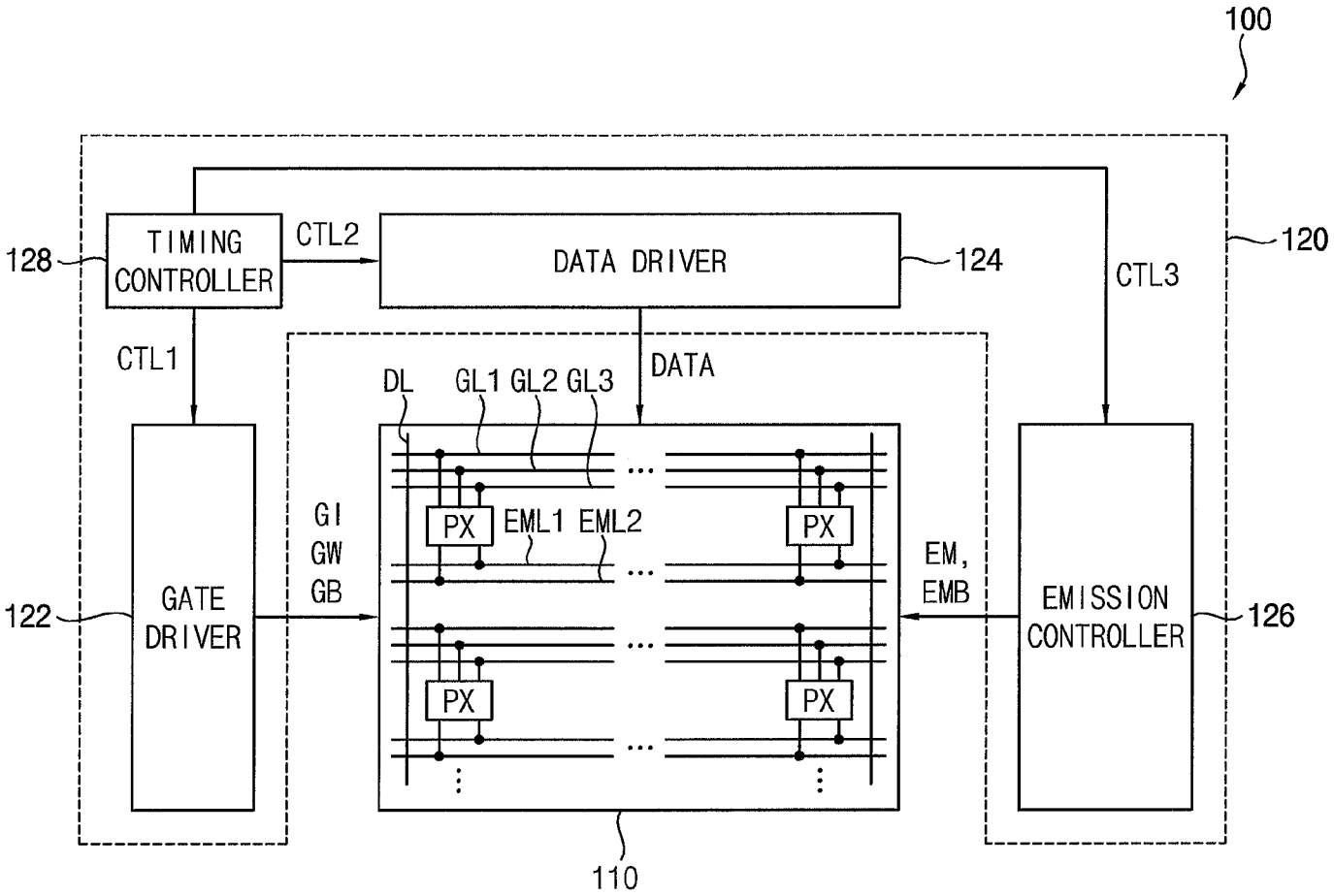
FIG. 1 is a block diagram illustrating a display device according to example embodiments.
Figure 2:
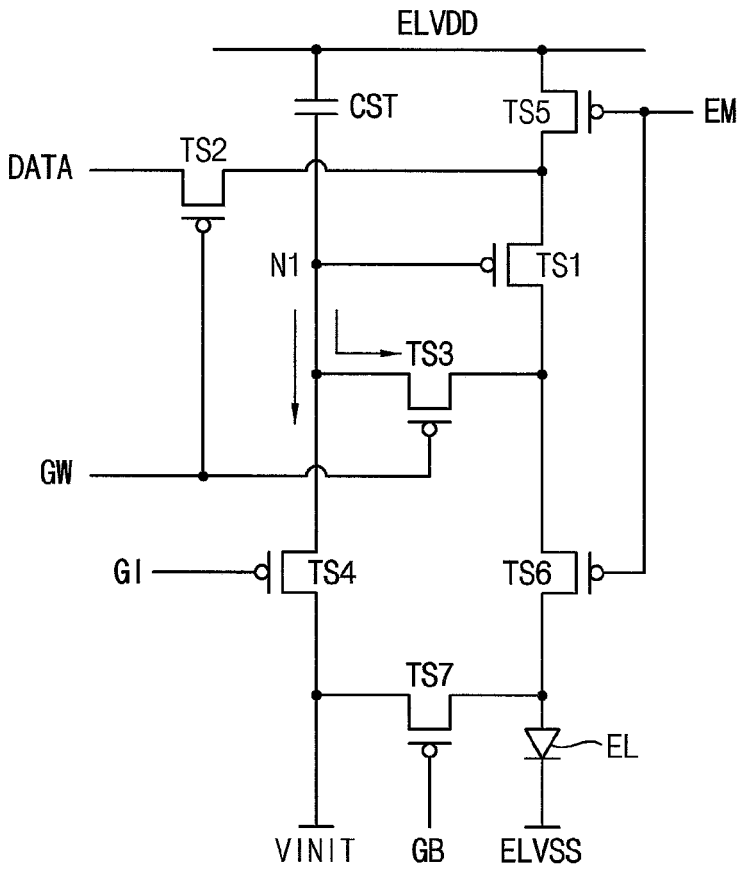
FIG. 2 is a circuit diagram illustrating an example of a pixel of the prior art.
Figure 3:
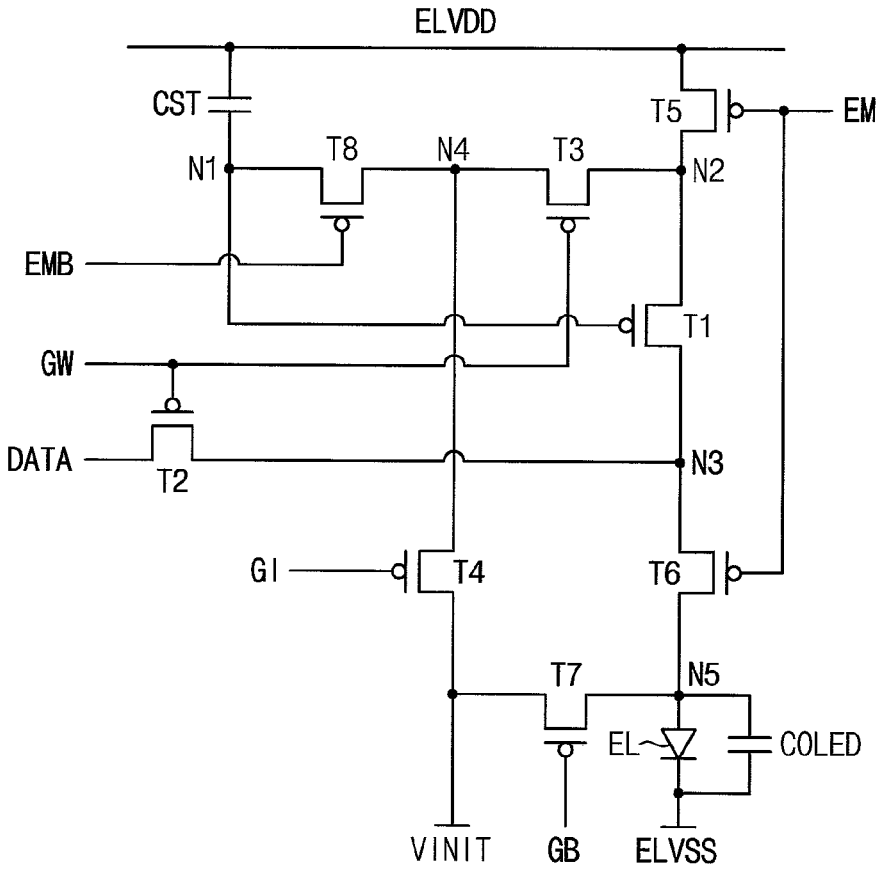
FIG. 3 is a circuit diagram illustrating an example of a pixel included in the display device of FIG. 1.

FIG. 1 is a block diagram illustrating a display device 100 according to example embodiments. FIG. 2 is a circuit diagram illustrating an example of a pixel of the prior art. FIG. 3 is a circuit diagram illustrating an example of a pixel included in the display device 100 of FIG. 1.

Referring to FIG. 1, a display device 100 may include a display panel 110 and a panel driver 120. In some example embodiments, the panel driver 120 may include a gate driver 122, a data driver 124, an emission controller 126, and a timing controller 128. In some example embodiments, the display device 100 may be an organic light emitting display device.

The display panel 110 may include a plurality of pixels PX for displaying an image. A plurality of gate lines GL1, GL2, GL3, a plurality of data lines DL, and a plurality of emission control lines EML1, EML2 coupled to the pixels PX may be formed on the display panel 110. Each of the pixels PX may receive a first gate signal GW, a second gate signal GI, and a third gate signal GB through the first gate line GL1, the second gate line GL2, and the third gate line GL3. Each of the pixels PX may receive a data voltage DATA through the data line DL. Each of the pixels PX may receive a first emission control signal EM and a second emission control signal EMB through the first emission control line EML1 and the second emission control line EML2. A first power voltage providing line that receives a first power voltage, a second power voltage providing line that receives a second power voltage, an initialization voltage providing line that receives an initialization voltage, etc. may be further formed on the display panel 110.

Referring to FIG. 2, a pixel PX having a 7T1C structure may include a first transistor TS1, a second transistor TS2, a third transistor TS3, a fourth transistor TS4, a fifth transistor TS5, a sixth transistor TS6, a seventh transistor TS7, and a storage capacitor CST. The pixel PX having the 7T1C structure may be operated in a first period in which a gate electrode of the first transistor TS1 is initialized, a second period in which a first electrode of an emission element EL is initialized, and a third period in which the emission element EL emits light. In the first period, the fourth transistor TS4 may turn on, an initialization voltage VINIT may be applied to a first node N1, and then the gate electrode of the first transistor TS1 may be initialized. In the second period, the second transistor TS2 may turn on and then the data voltage DATA may be provided to the first node N1. The third transistor TS3 may turn on and then the first transistor TS1 may be a diode connection. Thus, the data voltage DATA of which a threshold voltage of the first transistor TS1 is compensated may be stored in the storage capacitor CST. Further, the seventh transistor TS7 may turn on and a first electrode of the emission element EL may be initialized by receiving the initialization voltage VINIT in the second period. In the third period, the fifth transistor TS5 and the sixth transistor TS6 may turn on and a driving current generated in the first transistor TS1 may flow to the emission element EL. Here, the voltage of the gate electrode of the first transistor TS1 may be changed by a leakage current flow through a leakage path formed by the third transistor TS3 and the fourth transistor TS4. The driving current generated in the first transistor TS1 may be changed by a voltage change of the gate electrode of the first transistor TS1. Thus, luminance of the emission element EL may be changed.

The pixel PX of the display device 100 according to example embodiments may further include an eighth transistor T8 compared to the pixel PX having the 7T1C structure of the FIG. 2. The eighth transistor T8 may be coupled between a first node N1 corresponding to a gate electrode of a first transistor T1 and a fourth node N4, and a third transistor T3 may be coupled between the fourth node N4 and a second node N2 corresponding to the first electrode of the first transistor T1. Thus, the voltage of the fourth node N4 may be stabilized in the emission period. Therefore, the voltage change of the gate electrode of the first transistor T1 may be minimized.

Referring to FIG. 3, the pixel PX may include the first transistor T1, a second transistor T2, the third transistor T3, a fourth transistor T4, a fifth transistor T5, a sixth transistor T6, a seventh transistor T7, the eighth transistor T8, a first capacitor CST, and an emission element EL.

The first transistor T1 may include the gate electrode coupled to the first node N1, a first electrode coupled to the second node N2, and a second electrode coupled to a third node N3. The first transistor T1 may generate the driving current in response to the data voltage DATA. The first transistor T1 may be coupled between the second node N2 and the third node N3 and control the driving current. The first transistor T1 may generate the driving current in response to the data voltage DATA stored in the first capacitor CST. When the fifth transistor T5 and the sixth transistor T6 turn on, the first transistor T1 may provide the driving current to a first electrode of the emission element EL.

The second transistor T2 may include a gate electrode that receives the first gate signal GW, a first electrode that receives the data voltage DATA, and a second electrode coupled to the third node N3. The second transistor T2 may provide the data voltage DATA to the third node N3 in response to the first gate signal GW. The second transistor T2 may be coupled between the data line DL and the third node N3. The gate electrode of the second transistor T2 may be coupled to the first gate line GL1. When the second transistor T2 turns on, the data voltage DATA provided through the data line DL may be provided to the third node N3. The second transistor T2 may turn on in the second period in which the data voltage DATA is written.

The third transistor T3 may include a gate electrode that receives the first gate signal GW, a first electrode coupled to the fourth node N4, and a second electrode coupled to the second node N2. The third transistor T3 may provide the voltage of the second node N2 to the fourth node in response to the first gate signal GW. The third transistor T3 may be coupled between the second node N2 and the fourth node N4. The gate electrode of the third transistor T3 may be coupled to the first gate line GL1. The third transistor T3 may turn on in the second period in which the data voltage DATA is written.

The fourth transistor T4 may include a gate electrode that receives the second gate signal GI, a first electrode coupled to the fourth node N4, and a second electrode that receives the initialization voltage VINIT. The fourth transistor T4 may provide the initialization voltage VINIT to the fourth node N4 in response to the second gate signal GI. The fourth transistor T4 may be coupled between the fourth node N4 and the initialization voltage providing line. The gate electrode of the fourth transistor T4 may be coupled to the second gate line GL2. When the fourth transistor T4 turns on, the fourth node N4 may be initialized with the initialization voltage VINIT. The fourth transistor T4 may turn on in the first period in which the gate electrode of the first transistor T1 is initialized.

The fifth transistor T5 may include a gate electrode that receives the first emission control signal EM, a first electrode that receives the first power voltage ELVDD, and a second electrode coupled to the second node N2. The fifth transistor T5 may provide the first power voltage ELVDD to the second node N2 in response to the first emission control signal EM. The fifth transistor T5 may be coupled between the first power voltage providing line and the second node N2. The gate electrode of the fifth transistor T5 may be coupled to the first emission control line EML1. When the fifth transistor T5 turns on, the first power voltage ELVDD may be provided to the second node N2. The fifth transistor T5 may turn on in the third period in which the emission element EL emits light.

The sixth transistor T6 may include a gate electrode that receives the first emission control signal EM, a first electrode coupled to the third node N3, and a second electrode coupled to a fifth node N5. The sixth transistor T6 may provide a voltage of the third node N3 to the fifth node N5 in response to the first emission control signal EM. The sixth transistor T6 may be coupled between the third node N3 and the fifth node N5. The gate electrode of the sixth transistor T6 may be coupled to the first emission control line EML1. When the sixth transistor T6 turns on, the voltage of the third node N3 may be provided to the fifth node N5. The sixth transistor T6 may turn on in the third period in which the emission element EL emits light.

The seventh transistor T7 may include a gate electrode that receives the third gate signal GB, a first electrode that receives the initialization voltage VINIT, and the second electrode coupled to the fifth node N5. The seventh transistor T7 may provide the initialization voltage VINIT to the fifth node N5 in response to the third gate signal GB. The seventh transistor T7 may be coupled between the initialization voltage providing line and the fifth node N5. The gate electrode of the seventh transistor T7 may be coupled to the third gate line GL3. When the seventh transistor T7 turns on, the fifth node N5 may be initialized with the initialization voltage VINIT. The seventh transistor T7 may turn on in the second period in which the first electrode of the emission element EL is initialized.

The eighth transistor T8 may include a gate electrode that receives the second emission control signal EMB, a first electrode coupled to the first node N1, and a second electrode coupled to the fourth node N4. The eighth transistor T8 may provide the voltage of the fourth node N4 to the first node N1 in response to the second emission control signal EMB. The eighth transistor T8 may be coupled between the first node N1 and the fourth node N4. The gate electrode of the eighth transistor T8 may be coupled to the second emission control line EML2. When the eighth transistor T8 turns on, the voltage of the fourth node N4 may be provided to the first node N1. The eighth transistor T8 may turn on in the first period in which the gate electrode of the first transistor T1 is initialized and the second period in which the data voltage DATA is written.

The first capacitor CST may include a first electrode that receives the first power voltage ELVDD and a second electrode coupled to the first node N1. The first capacitor CST may be coupled between the first power voltage providing line and the first node N1. The first capacitor CST may store the data voltage DATA provided through the first node during the second period.

The emission element EL may include a first electrode coupled to the fifth node N5 and a second electrode that receives the second power voltage ELVSS. The emission element EL may be coupled between the fifth node N5 and the second power voltage providing line. The initialization voltage VINIT may be provided to the fifth node and the first electrode of the emission element El may be initialized during the second period. The emission element EL may emit light during the third period.

An OLED capacitor COLED may store a difference between the voltage of the fifth node N5 and the second power voltage. The OLED capacitor COLED may uniformly maintain the driving current flowing through the emission element EL.

The first through eighth transistors T1 through T8 may turn on in response to a voltage corresponding to a first logic level and turn off in response to a voltage corresponding to a second logic level. When the first through eighth transistors T1 through T8 are implemented as PMOS (p-channel oxide semiconductor) transistors as described in FIG. 3, the first logic level may be a low level voltage (e.g., 0V) and the second logic level may be a high level voltage (e.g., 10V).

Although the pixel PX of which the first through eighth transistors T1 through T8 implemented as the PMOS transistors is described in FIG. 3, the first through eighth transistors T1 through T8 are not limited thereto. For example, each of the first through eighth transistors T1 through T8 may be implemented as a NMOS (n-channel oxide semiconductor) transistor.

When the first through eighth transistors T1 through T8 are implemented as the NMOS transistors, the first logic level may be the high level voltage (e.g., 10V), and the second logic level may be the low level voltage (e.g., 0V). In this case, each of the first through eighth transistors T1 through T8 may be implemented as a LTPS (low temperature poly silicon) thin film transistor, an oxide thin film transistor, or a LTPO (low temperature polycrystalline oxide) thin film transistor.

Referring to FIG. 1, the gate driver 122 may provide the first gate signal GW to the pixels PX through the first gate line GL1, provide the second gate signal GI to the pixels through the second gate line GL2, and provide the third gate signal GB to the pixels through the third gate line GL3 based on a first control signal CTL1. Here, the first gate signal GW may be a control signal for applying the data voltage DATA to the pixels and the second gate signal GI and the third gate signal GB may be a control signal for applying the initialization voltage VINIT to the pixels PX.

The data driver 124 may convert a digital image data to an analog data voltage based on a second control signal CTL2. The data driver 124 may provide the data voltage DATA to the pixels through the data line DL.

The emission controller 126 may provide the first emission control signal EM to the pixels PX through the first emission control line EML1 and provide the second emission control signal EMB to the pixels PX through the second emission control line EML2 based on a third control signal CTL3. The first emission control signal EM may be a control signal for emitting the pixels PX. In some example embodiments, the second emission control signal EMB may be an inversion signal of the first emission control signal EM.

The timing controller 128 may control the gate driver 122, the data driver 124, and the emission controller 126. For example, the timing controller 128 may receive the control signal from an external system (e.g., a system board). The timing controller 128 may generate the first control signal CTL1, the second control signal CTL2, and the third control signal CTL3 to control each of the gate driver 122, the data driver 124, and the emission controller 126. The first control signal CTL1 for controlling the gate driver 122 may include a vertical start signal, a clock signal, etc. The second control signal CTL2 for controlling the data driver 124 may include a horizontal start signal, a load signal, an image data, etc. The third control signal CTL3 for controlling the emission controller 126 may include a clock signal, etc. The timing controller 128 may generate the digital image data to match an operating condition of the display panel 110 based on an input image data and provide the digital image data to the data driver 124.

Thus, the display device 100 according to example embodiments may minimize the change of the voltage level of the gate electrode of the first transistor T1 (i.e., a driving transistor) during the emission period so that the change of the luminance of the pixel may be prevented.

Figure 4:
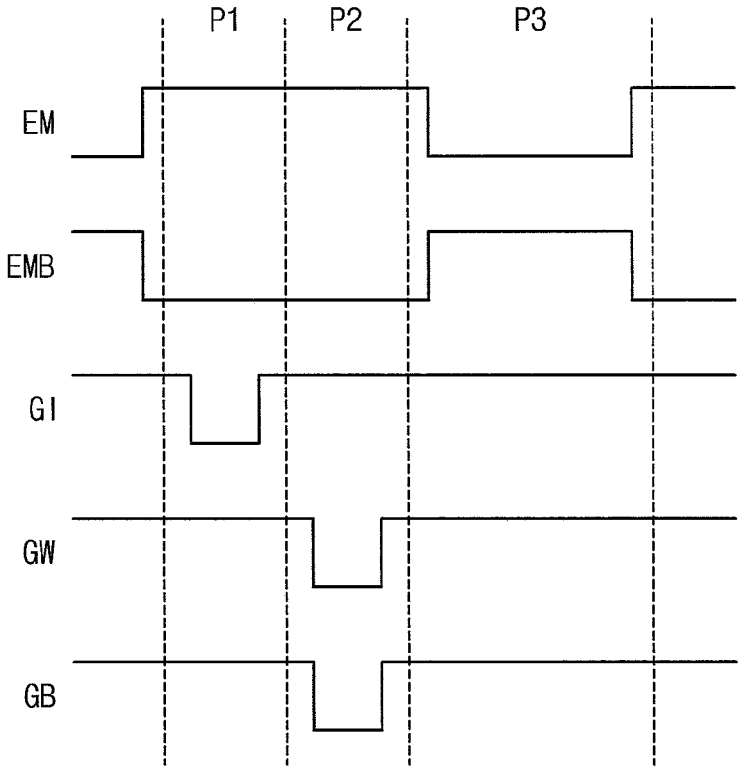
FIG. 4 is a timing diagram illustrating an example of a driving operation of the pixel included in the display device of FIG. 1.
Figure 5A:
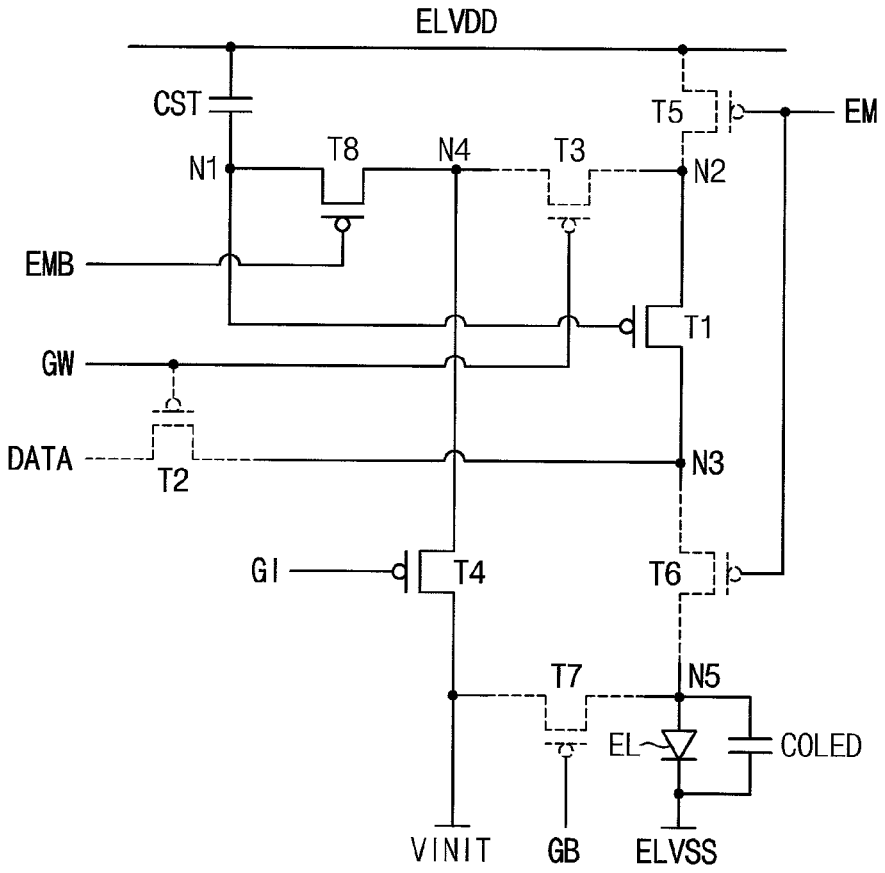
FIGS. 5A, 5B, and 5C are circuit diagrams illustrating the pixel operated based on the timing diagram of FIG. 4.
Figure 5B:
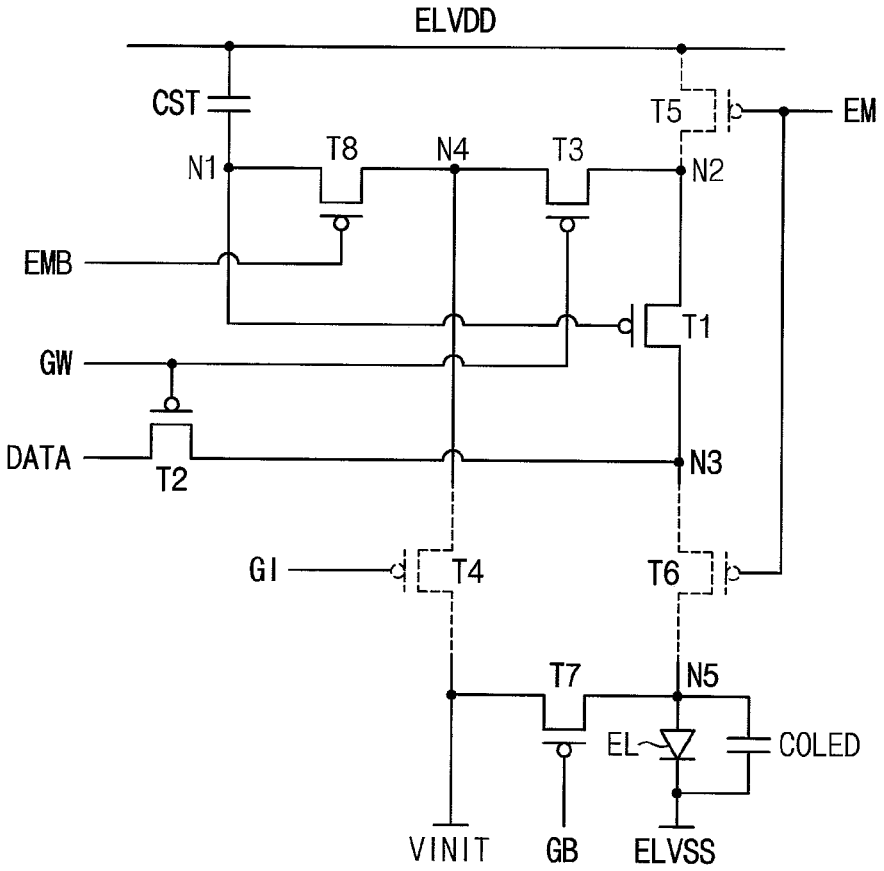
Figure 5C:
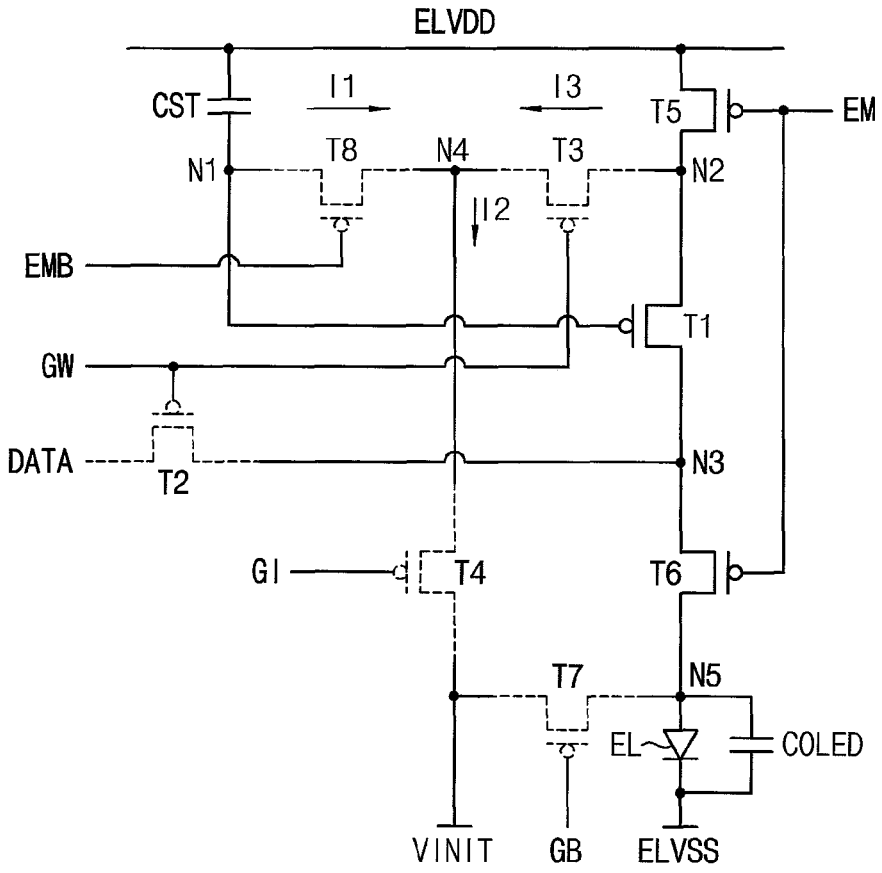

FIG. 4 is a timing diagram illustrating an example of a driving operation of the pixel included in the display device of FIG. 1. FIGS. 5A through 5C are circuit diagrams illustrating for describing the pixel operated based on the timing diagram of FIG. 4.

Referring to FIG. 4, a frame may include a first period P1, a second period P2, and a third period P3. In the first period P1, the gate electrode of the first transistor T1 may be initialized. In the second period P2, the first electrode of the emission element El is initialized and the data voltage DATA that compensates the threshold voltage of the first transistor T1 is written. In the third period P3, the emission element EL may emit light based on the data voltage DATA.

Referring to FIGS. 4 and 5A, in the first period P1, the second gate signal GI and the second emission control signal EMB may be activated and the first gate signal GW, the third gate signal GB, and the first emission control signal EM may be inactivated. That is, the second gate signal GI and the second emission control signal EMB may have the first logic level (i.e., the low level voltage), and the first gate signal GW, the third gate signal GB, and the first emission control signal EM may have the second logic level (i.e., a high level voltage) in the first period P1. The fourth transistor T4 may turn on in response to the second gate signal GI having the first logic level, and the eighth transistor T8 may turn on in response to the second emission control signal EMB having the first logic level. Further, the second transistor T2 and the third transistor T3 may turn off in response to the first gate signal GW having the second logic level. The seventh transistor T7 may turn off in response to the third gate signal GB having the second logic level. The fifth transistor G5 and the sixth transistor T6 may turn off in response to the first emission control signal EM having the second logic level. When the fourth transistor T4 turns on, the initialization voltage VINIT provided through the initialization voltage providing line may be provided to the fourth node N4 through the fourth transistor T4. When the eighth transistor T8 turns on, the voltage of the fourth node N4 (that is, the initialization voltage VINIT) may be provided to the first node N1. The gate electrode of the first transistor T1 may be initialized with the initialization voltage VINIT because the first node N1 corresponds to the gate electrode of the first transistor T1.

Referring to FIGS. 4 and 5B, in the second period P2, the first gate signal GW, the third gate signal GB, and the second emission control signal EMB may be activated, and the second gate signal GI and the first emission control signal EM may be inactivated. That is, the first gate signal GW, the third gate signal GB, and the second emission control signal EMB may have the first logic level (i.e., the low level voltage), and the second gate signal GI and the first emission control signal EM may have the second logic level (i.e., the high level voltage) in the second period P2. The second transistor T2 and the third transistor T3 may turn on in response to the first gate signal GW having the first logic level, the seventh transistor T7 may turn on in response to the third gate signal GB having the first logic level, and the eighth transistor T8 may turn on in response to the second emission control signal EMB having the first logic level. Further, the fourth transistor T4 may turn off in response to the second gate signal GI having the second logic level, and the fifth transistor T5 and the sixth transistor T6 may turn off in response to the first emission control signal EM having the second logic level. When the second transistor T2 turns on, the data voltage DATA provided through the data line may be provided to the third node N3 through the second transistor T2. When the third transistor T3 turns on, the voltage of the second node N2 may be provided to the fourth node N4. When the eighth transistor T8 turns on, the voltage of the fourth node N4 may be provided to the first node N1.

That is, the data voltage DATA of the second node N2 may be provided to the first node N1 through the third transistor T3 and the eighth transistor T8. The first transistor T1 may be the diode connection because the second node N2 corresponds to the first electrode of the first transistor T1 and the first node N1 correspond to the gate electrode of the first transistor T1. Thus, the data voltage DATA that compensate the threshold voltage of the first transistor T1 may be stored in the first capacitor CST. Further, when the seventh transistor T7 turns on, the initialization voltage VINIT provided through the initialization voltage providing line may be provided to the fifth node N5 through the seventh transistor T7. The first electrode of the emission element EL may be initialized with the initialization voltage VINIT because the fifth node N5 corresponds to the first electrode of the emission element EL.

Referring to FIGS. 4 and 5C, in the third period P3, the first emission control signal EM is activated, and the first gate signal GW, the second gate signal GI, the third gate signal GB, and the second emission control signal EMB may be inactivated. That is, the first emission control signal EM may have the first logic level (i.e., the low level voltage), and the first gate signal GW, the second gate signal GI, the third gate signal GB, and the second emission control signal EMB may have the second logic level (i.e., the high level voltage) in the third period P3. The fifth transistor T5 and the sixth transistor T6 may turn on in response to the first emission control signal EM having the first logic level. Further, the fourth transistor T4 may turn off in response to the second gate signal GI having the second logic level. The second transistor T2 and the third transistor T3 may turn off in response to the first gate signal GW having the second logic level. The seventh transistor T7 may turn off in response to the third gate signal GB having the second logic level. The eighth transistor T8 may turn off in response to the second emission control signal EMB having the second logic level.

When the fifth transistor T5 turns on, the first power voltage ELVDD provided through the first power voltage providing line may be provided to the second node N2 through the fifth transistor T5. When the sixth transistor T6 turns on, the voltage of the third node N3 may be provided to the fifth node N5 through the sixth transistor T6. The first transistor T1 may generate the driving current in response to the data voltage DATA provided to the gate electrode of the first transistor T1. The driving current generated in the first transistor T1 may be provided to the first electrode of the emission element EL. Here, a first leakage current I1 may flow from the first node N1 to the fourth node N4 through the eighth transistor T8 coupled to the gate electrode of the first transistor T1 because of the voltage difference of the first node N1 and the fourth node N4. A second leakage current I2 may flow from the fourth node N4 to the initialization voltage providing line through the fourth transistor T4 because the voltage level of the fourth node N4 is higher than the initialization voltage VINIT. A third leakage current I3 may flow from the second node to the fourth node N4 through the third transistor T3 because the voltage of the second node N2 (i.e., the first power voltage ELVDD) is higher than the voltage of the fourth node N4.

The voltage of the fourth node N4 may be stabilized to a specified voltage level between the first power voltage ELVDD and the initialization voltage VINIT by the third leakage current I3 provided to the fourth node N4 through the third transistor T3 and the second leakage current I2 flows from the fourth node N4 through the fourth transistor T4. The first leakage current I1 that flows from the first node N1 to the fourth node N4 through the eighth transistor T8 may be decrease. Thus, the change of the voltage level of the gate electrode of the first transistor T1 may be minimized.

As described above, the pixel of the display device according to example embodiments may minimize the change of the voltage level of the gate electrode of the first transistor T1 during the third period P3 in which the emission element EL emits light. Thus, the change of the luminance of the pixel may be prevented.

Figure 6:
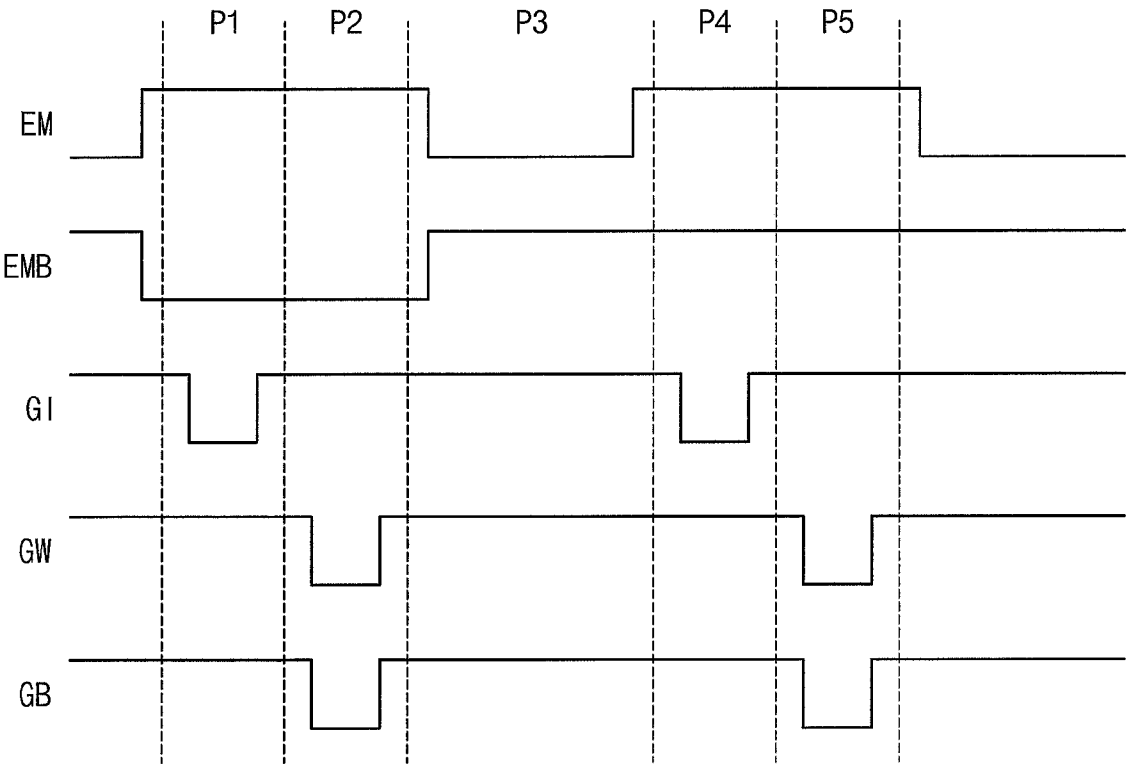
FIG. 6 is a timing diagram illustrating for describing another example of the driving operation of the pixel included in the display device of FIG. 1.
Figure 7A:
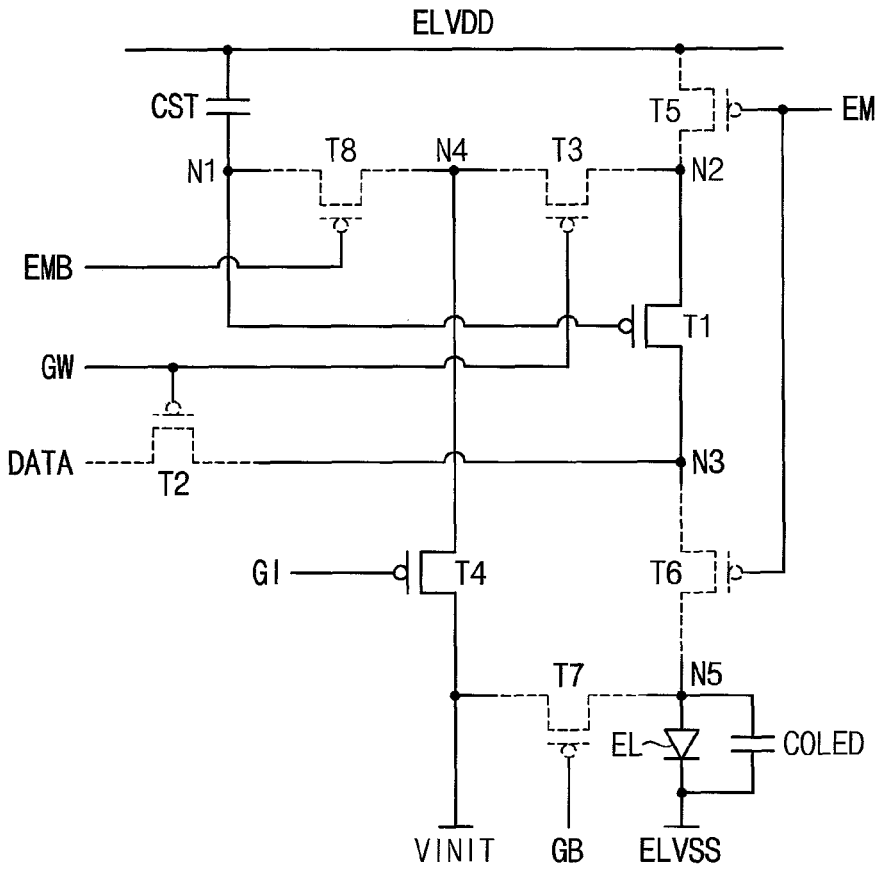
FIGS. 7A and 7B are circuit diagrams illustrating the pixel operated based on the timing diagram of FIG. 6.
Figure 7B:
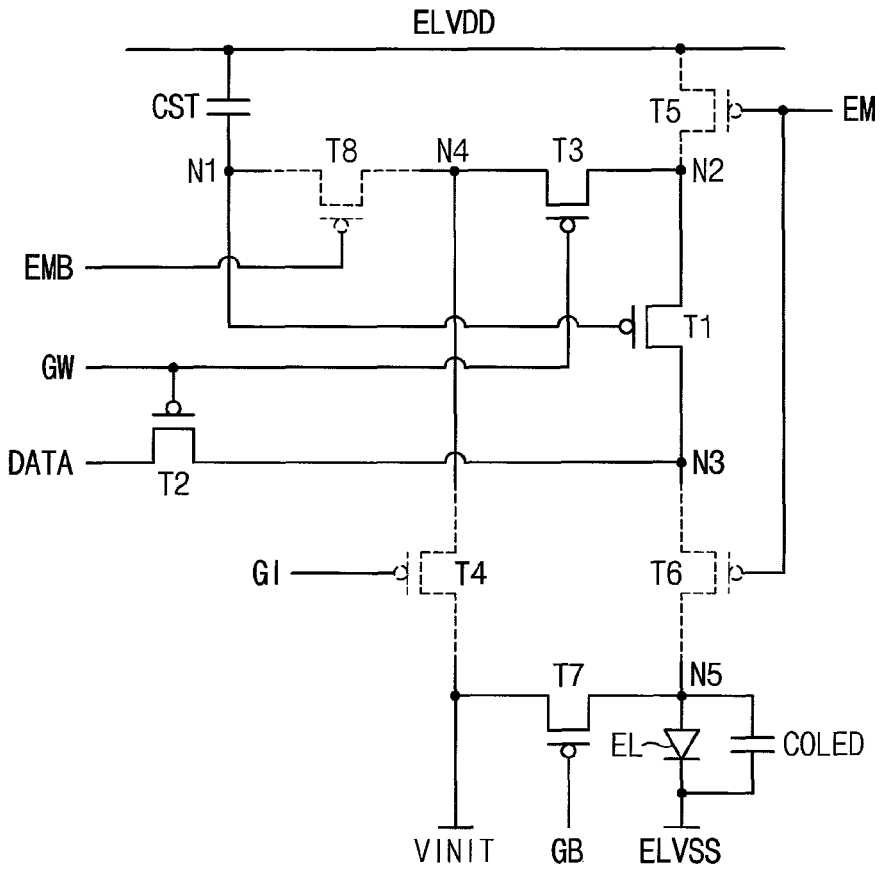

FIG. 6 is a timing diagram illustrating another example of the driving operation of the pixel included in the display device of FIG. 1. FIGS. 7A and 7B are circuit diagrams illustrating for describing the pixel operated based on the timing diagram of FIG. 6.

Referring to FIG. 6, a frame may include a first period P1, a second period P2, a third period P3, a fourth period P4, and a fifth period P5. An operation of the pixel in the first period P1, the second period P2, and the third period P3 of FIG. 6 may be substantially the same as the operation of the pixel in the first period P1, the second period P2, and the third period P3 of FIG. 4. The same or similar reference numerals may be used to indicate the same or similar elements, and duplicated descriptions are omitted. The fourth node N4 may be refreshed during the fourth period P4 and the fifth period P5. The third period P3, the fourth period P4 and the fifth period P5 may be included (repeated) at least one more time in one frame.

Referring to FIGS. 6 and 7A, in the fourth period P4, the second gate signal GI may be activated, and the first gate signal GW, the third gate signal GB, the first emission control signal EM, and the second emission control signal EMB may be inactivated. That is, the second gate signal GI may have the first logic level (i.e., the low level voltage). The first gate signal GW, the third gate signal GB, the first emission control signal EM, and the second emission control signal EMB may have the second logic level (i.e., the high level) in the fourth period P4. The fourth transistor T4 may turn on in response to the second gate signal GI having the first logic level. Further, the second transistor T2 and the third transistor T3 turn off in response to the first gate signal GW having the second logic level. The seventh transistor T7 may turn off in response to the third gate signal GB having the second logic level. Further, the fifth transistor T5 and the sixth transistor T6 may turn off in response to the first emission control signal EM having the second logic level. The eighth transistor T8 may turn off in response to the second emission control signal EMB having the second logic level.

When the fourth transistor T4 turns on, the initialization voltage VINIT provided through the initialization voltage providing line may be provided to the fourth node N4 through the fourth transistor T4. The pixel according to example embodiments may stabilize the voltage of the fourth node N4 to a specified voltage level between the first power voltage ELVDD and the initialization voltage VINIT based on the third leakage current provided to the fourth node N4 through the third transistor T3 and the second leakage current leaving the fourth node N4 through the fourth transistor T4. Here, the voltage level of the fourth node N4 may be slowly changed because an amount of the third leakage current and an amount of the second leakage current are different. The voltage of the fourth node N4 may be refreshed by providing the initialization voltage VINIT to the fourth node N4 through the fourth transistor T4 during the fourth period P4.

Referring to FIGS. 6 and 7B, in the fifth period P5, the first gate signal GW and the third gate signal GB may be activated, and the second gate signal GI, the first emission control signal EM, and the second emission control signal EMB may be inactivated. That is, the first gate signal GW and the third gate signal GB may have the first logic level (i.e., the low level voltage). The second gate signal GI, the first emission control signal EM, and the second emission control signal EMB may have the second logic level (i.e., the high level voltage) in the fifth period P5. The second transistor T2 and the third transistor T3 may turn on in response to the first gate signal GW. The seventh transistor T7 may turn on in response to the third gate signal GB having the first logic level. Further, the fourth transistor T4 may turn off in response to the second gate signal GI having the second logic level. The fifth transistor T5 and the sixth transistor T6 may turn off in response to the first emission control signal EM having the second logic level. The eighth transistor T8 may turn off in response to the second emission control signal EMB having the second logic level.

When the second transistor T2 and the third transistor T3 turn on, the data voltage DATA provided through the data line may be provided to the fourth node N4 through the second transistor T2, the first transistor T1, and the third transistor T3. Here, the data voltage DATA may have a voltage level that displays white color (e.g., 255 grayscale) on the display panel. The voltage of the fourth node N4 may be refreshed by providing the data voltage DATA to the fourth node N4 through the second transistor T2, the first transistor T1, and the third transistor T3 during the fifth period P5.

As described above, the pixel according to example embodiments may prevent the change of the luminance by refreshing the voltage of the fourth node N4 during the fourth period P4 and the fifth period P5.

Figure 8:
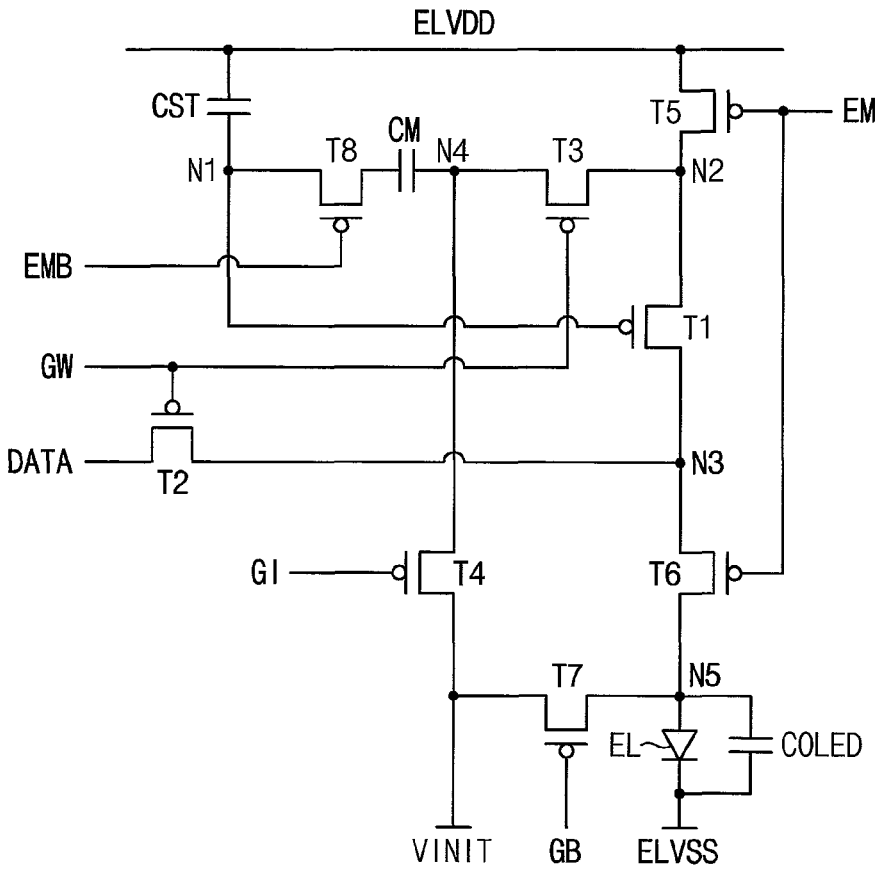
FIG. 8 is a circuit diagram illustrating another example of a pixel included in the display device of FIG. 1.

FIG. 8 is a circuit diagram illustrating another example of a pixel included in the display device of FIG. 1.

Referring to FIG. 8, a pixel PX may include a first transistor T1, a second transistor T2, a third transistor T3, a fourth transistor T4, a fifth transistor T5, a sixth transistor T6, a seventh transistor T7, an eighth transistor T8, a first capacitor CST, a second capacitor CM, and an emission element EL. The pixel of FIG. 7 may be substantially the same as the pixel of FIG. 3 except that includes the second capacitor CM. The same or similar reference numerals may be used to indicate the same or similar elements, and duplicated descriptions are omitted.

The second capacitor CM may include a first electrode coupled to the second electrode of the eighth transistor T8 and a second electrode coupled to the fourth node N4. The second capacitor CM may be coupled between the second electrode of the eighth transistor T8 and the fourth node N4. The second capacitor CM may maintain the voltage of the fourth node during the third period P3 in which the eighth transistor T8 turns off and the emission element EL emits light. Further, the second capacitor CM may maintain the voltage of the fourth node N4 during the fourth period P4 and the fifth period P5 in which the eighth transistor T8 turns off and the voltage of the fourth node N4 is refreshed.

As described above, the pixel of FIG. 8 may maintain the voltage of fourth node N4 by including the second capacitor CM between the eighth transistor T8 and the fourth node N4.

Figure 9:
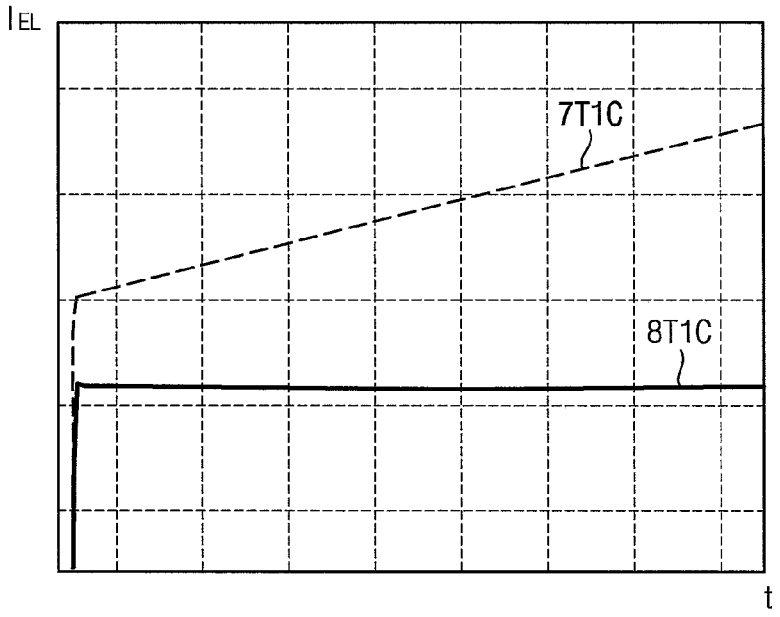
FIG. 9 is a graph illustrating a change of driving current of the pixel included in the display device of FIG. 1.

FIG. 9 is a graph illustrating a change of driving current of the pixel included in the display device of FIG. 1.

The graph of FIG. 9 represents a change of a driving current flowing through an emission element during an emission period in a pixel of prior art (7T1C structure) and in a pixel according to example embodiments (8T1C). As described above, the leakage current may occur through the third transistor and the fourth transistor coupled to the first transistor (i.e., the driving transistor) during the third period (i.e., the emission period) in which the emission element emits light in the pixel having the 7T1C structure. Thus, the voltage of the gate electrode of the first transistor may be changed, and then the driving current may be changed as described in FIG. 8.

The pixel having the 8T1C structure according to example embodiments may include the eighth transistor coupled to the gate electrode of the first transistor (i.e., the driving transistor). The pixel having the 8T1C structure may control the leakage current flowing through the third transistor and the fourth transistor coupled to the eighth transistor and may maintain the voltage of the second electrode of the eighth transistor (i.e., the fourth node). Thus, the change of the voltage of the gate electrode of the first transistor may be prevented. Therefore, the driving current generated in the first transistor may be constantly maintained as described in FIG. 8.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and features of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A pixel of a display device comprising:

a first transistor including a gate electrode coupled to a first node, a first electrode coupled to a second node, and a second electrode coupled to a third node;

a second transistor including a gate electrode that is configured to receive a first gate signal, a first electrode that is configured to receive a data voltage, and a second electrode coupled to the third node;

a third transistor including a gate electrode that is configured to receive the first gate signal, a first electrode coupled to a fourth node, and a second electrode coupled to the second node;

a fourth transistor including a gate electrode that is configured to receive a second gate signal, a first electrode coupled to the fourth node, and a second electrode that is configured to receive an initialization voltage;

a fifth transistor including a gate electrode that is configured to receive a first emission control signal, a first electrode that is configured to receive a first power voltage, and a second electrode coupled to the second node;

a sixth transistor including a gate electrode that is configured to receive the first emission control signal, a first electrode coupled to the third node, and a second electrode coupled to a fifth node;

a seventh transistor including a gate electrode that is configured to receive a third gate signal, a first electrode that is configured to receive the initialization voltage, and a second electrode coupled to the fifth node;

an eighth transistor including a gate electrode that is configured to receive a second emission control signal, a first electrode coupled to the first node, and a second electrode coupled to the fourth node;

a first capacitor including a first electrode that is configured to receive the first power voltage and a second electrode coupled to the first node; and an emission element including a first electrode coupled to the fifth node and a second electrode that is configured to receive a second power voltage.

2. The pixel of the display device of claim 1, wherein the second emission control signal is an inversion signal of the first emission control signal.

3. The pixel of the display device of claim 1, further comprising:

a second capacitor coupled between the second electrode of the eighth transistor and the fourth node.

4. The pixel of the display device of claim 1, wherein the first gate signal, the second gate signal, and the third gate signal are activated more than one time in a frame, and wherein the second emission control signal is activated once in a frame.

5. The pixel of the display device of claim 4, wherein the gate electrode of the first transistor is initialized with the initialization voltage while the second gate signal and the second emission control signal are activated and the first gate signal, the third gate signal, and the first emission control signal are inactivated.

6. The pixel of the display device of claim 4, wherein the first electrode of the emission element is initialized with the initialization voltage and the data voltage that compensates a threshold voltage of the first transistor is written while the first gate signal, the third gate signal, and the second emission control signal are activated and the second gate signal and the first emission control signal are inactivated.

7. The pixel of the display device of claim 4, wherein the emission element emits light while the first emission control signal is activated and the first gate signal, the second gate signal, and the third gate signal are inactivated.

8. The pixel of the display device of claim 4, wherein the fourth node is initialized with the initialization voltage while the second gate signal is activated and the first gate signal, the third gate signal, the first emission control signal, and the second emission control signal are inactivated.

9. The pixel of the display device of claim 4, wherein the first electrode of the emission element is initialized with the initialization voltage and the fourth node is initialized with the data voltage while the first gate signal and the third gate signal are activated and the second gate signal, the first emission control signal and the second emission control signal are inactivated.

10. A display device comprising:

a display panel including a plurality of pixels; and a panel driver that is configured to drive the display panel, wherein each of the pixels includes:

a first transistor including a gate electrode coupled to a first node, a first electrode coupled to a second node, and a second electrode coupled to a third node;

a second transistor including a gate electrode that is configured to receive a first gate signal, a first electrode that is configured to receive a data voltage, and a second electrode coupled to the third node;

a third transistor including a gate electrode that is configured to receive the first gate signal, a first electrode coupled to a fourth node, and a second electrode coupled to the second node;

a fourth transistor including a gate electrode that is configured to receive a second gate signal, a first electrode coupled to the fourth node, and a second electrode that is configured to receive an initialization voltage;

a fifth transistor including a gate electrode that is configured to receive a first emission control signal, a first electrode that is configured to receive a first power voltage, and a second electrode coupled to the second node;

a sixth transistor including a gate electrode that is configured to receive the first emission control signal, a first electrode coupled to the third node, and a second electrode coupled to a fifth node;

a seventh transistor including a gate electrode that is configured to receive a third gate signal, a first electrode that is configured to receive the initialization voltage, and a second electrode coupled to the fifth node;

an eighth transistor including a gate electrode that is configured to receive a second emission control signal, a first electrode coupled to the first node, and a second electrode coupled to the fourth node;

a first capacitor including a first electrode that is configured to receive the first power voltage and a second electrode coupled to the first node; and an emission element including a first electrode coupled to the fifth node and a second electrode that is configured to receive a second power voltage.

11. The display device of claim 10, wherein the second emission control signal is an inversion signal of the first emission control signal.

12. The display device of claim 10, wherein further comprising:

a second capacitor coupled between the second electrode of the eighth transistor and the fourth node.

13. The display device of claim 10, wherein the panel driver is configured to drive the pixels in a driving method that includes a first period during which the gate electrode of the first transistor is initialized, a second period during which the first electrode of the emission element is initialized and the data voltage that compensates a threshold voltage of the first transistor is written, and a third period during which the emission element emits light.

14. The display device of claim 13, wherein the second gate signal and the second emission control signal are activated and the first gate signal, the third gate signal, and the first emission control signal are inactivated in the first period.

15. The display device of claim 13, wherein the first gate signal, the third gate signal, and the second emission control signal are activated, and the second gate signal and the first emission control signal are inactivated in the second period.

16. The display device of claim 13, wherein the first emission control signal is activated, and the first gate signal, the second gate signal, the third gate signal, and the second emission control signal are inactivated during the third period.

17. The display device of claim 13, wherein the driving method further includes a fourth period and a fifth period during which the fourth node is refreshed.

18. The display device of claim 17, wherein the second gate signal is activated and the first gate signal, the third gate signal, the first emission control signal, and the second emission control signal are inactivated during the fourth period.

19. The display device of claim 17, wherein the first gate signal and the third gate signal are activated, and the second gate signal, the first emission control signal, and the second emission control signal are inactivated during the fifth period.

20. The display device of claim 17, wherein the driving method includes the third period, the fourth period, and the fifth period more than one time in a frame.

* * * * *